US007663599B1

(12) United States Patent
Lin et al.

(10) Patent No.: US 7,663,599 B1
(45) Date of Patent: Feb. 16, 2010

(54) DRIVING CIRCUIT FOR LED BACKLIGHT SYSTEM

(75) Inventors: Chi-Hsiu Lin, Yun-Lin Hsien (TW); Chien-Yang Chen, Taipei (TW); Shin-Chang Lin, Taipei Hsien (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 0 days.

(21) Appl. No.: 12/390,511

(22) Filed: Feb. 23, 2009

(30) Foreign Application Priority Data

Dec. 8, 2008 (TW) ..... 97147615 A

(51) Int. Cl.
*G09G 3/36* (2006.01)

(52) U.S. Cl. ..... 345/102; 345/82

(58) Field of Classification Search ..... 345/102, 345/76, 82, 87, 204
See application file for complete search history.

(56) References Cited

U.S. PATENT DOCUMENTS 6,807,430 B2 * 10/2004 Woods et al. ..... 455/550.1
7,605,809 B2 * 10/2009 Wey et al. ..... 345/212
7,615,974 B1 * 11/2009 Xu ..... 323/271
2004/0095081 A1 * 5/2004 Kernahan ..... 315/307
2004/0095108 A1 * 5/2004 Kernahan et al. ..... 323/282
2005/0156644 A1 * 7/2005 Karnahan et al. ..... 327/218
2007/0080905 A1 * 4/2007 Takahara ..... 345/76
2007/0171271 A1 * 7/2007 Wey et al. ..... 347/237
2007/0229446 A1 * 10/2007 Oh et al. ..... 345/102
2007/0279335 A1 * 12/2007 Lin et al. ..... 345/76
2008/0157699 A1 * 7/2008 Lee et al. ..... 315/294
2008/0231621 A1 * 9/2008 Chang et al. ..... 345/211
2008/0252665 A1 * 10/2008 Date ..... 345/690

* cited by examiner

*Primary Examiner*—Ricardo L Osorio
(74) *Attorney, Agent, or Firm*—Winston Hsu

(57) ABSTRACT

A driving circuit for an LED backlight system is disclosed. The driving circuit includes an input voltage, an input resistor, an operational amplifier, a first transistor and a current calculation unit. The operational amplifier has a positive input terminal electrically connected to the input voltage through the input resistor, and an output terminal electrically connected to its negative input terminal thorough a feedback network. The first transistor is utilized for draining a reference current to control an output voltage of the operational amplifier according to the input voltage and the input resistor. The current calculation unit is utilized for generating a plurality of working currents proportional to the reference current to drive a plurality of LED strings according to the output voltage of the operational amplifier.

10 Claims, 7 Drawing Sheets

DRIVING CIRCUIT FOR LED BACKLIGHT SYSTEM

BACKGROUND OF THE INVENTION

1. Field of the Invention

The present invention relates to a driving circuit for an LED backlight system, and more particularly, to a driving circuit driving the LED backlight system by a constant current source.

2. Description of the Prior Art

Since a liquid crystal display (LCD) can not illuminate, it must rely on a backlight system for providing an adequate and uniform light source to normally display images. Conventionally, Cold Cathode Fluorescent Lamps (CCFLs) have become the primary light source of the LCD due to high brightness and low cost. However, the CCFLs, containing mercurate, have been replaced by light emitting diodes (LEDs), as known for high color temperature, compact size, power saving, and rapid response, to meet consumer's demands for color, size, and lifetime, since the eco-awareness has been considered lately.

Generally, the driving approach of the LEDs can be categorized into two types, voltage driving and current driving to be exact. Please refer to FIG. 1, which is a schematic diagram of an LED backlight system 10 when the voltage driving is exploited. As shown in FIG. 1, the LED backlight system consists of LEDs D1~Dn connected in parallel, and controls the current level through each of the LEDs by using current limiting resistors S1~Sn, so as to control the brightness of each of the LEDs. Nevertheless, the use of such driving approach makes the current through each of the LEDs liable to diverge due to differences between the current limiting resistors and the forward bias of the LEDs, and thus leads to un-uniform distribution of the brightness for the backlight system.

To improve the un-uniform distribution, the backlight system changes ways to connect the LEDs from parallel to series, as shown in FIG. 2. Not only are the currents through each of the LEDs the same, but also power usage efficiency has been boosted by avoiding the use of the current limiting resistors. Yet the forward bias of the LED varies with temperature, the current through an LED string rises up when the temperature increases, causing that the brightness of the LEDs varies with the temperature.

Thus, in the prior art, the backlight system usually exploits the current driving to drive the LED strings, such that the current through each of the LEDs is equal and the current can be prevented from varying with the temperature. Thus, effectively controlling the brightness of the LEDs can be achieved, as shown in FIG. 3. In this situation, how to provide an efficient driving circuit with a constant current source becomes an important issue.

SUMMARY OF THE INVENTION

It is therefore an objective of the present invention to provide a driving circuit for an LED backlight system.

The present invention discloses a driving circuit for an LED backlight system. The driving circuit includes an input voltage, an input resistor, an operational amplifier, a first transistor and a current calculation unit. The operational amplifier has a positive input terminal, a negative terminal and an output terminal. The positive input terminal is coupled to the input voltage through the input resistor. The output terminal is coupled to the negative input terminal through a feedback network. The first transistor has a first terminal, a second terminal and a third terminal. The first terminal is coupled to the positive input terminal of the operational amplifier. The second terminal is coupled to a reference voltage through a reference resistor. The third terminal is coupled to the output terminal of the operational amplifier, and used for draining a reference current to control an output voltage of the operational amplifier according to the input voltage and the input resistor. The current calculation unit is coupled to the output terminal of the operational amplifier and the reference voltage, and used for generating a plurality of working currents proportional to the reference current to drive a plurality of LED strings according to the output voltage of the operational amplifier.

These and other objectives of the present invention will no doubt become obvious to those of ordinary skill in the art after reading the following detailed description of the preferred embodiment that is illustrated in the various figures and drawings.

DETAILED DESCRIPTION

The certain nouns are used for the specific components in the specification and the following claims. As known by those skilled in the art, manufactures may use different designations for the same components. The components are not distinguished by the designations but the functions in the specification and the following claims. The word "comprise" is an open phrase and therefore should be translated to "include and not limited herein". In addition, the word "couple" can refer to any direct or indirect connection in electrical field. Thus, if the statement "a first device is coupled to a second device" is described, this represents the first device is directly coupled to the second device or the first device is coupled to the second device through the other devices.

Figure 1:
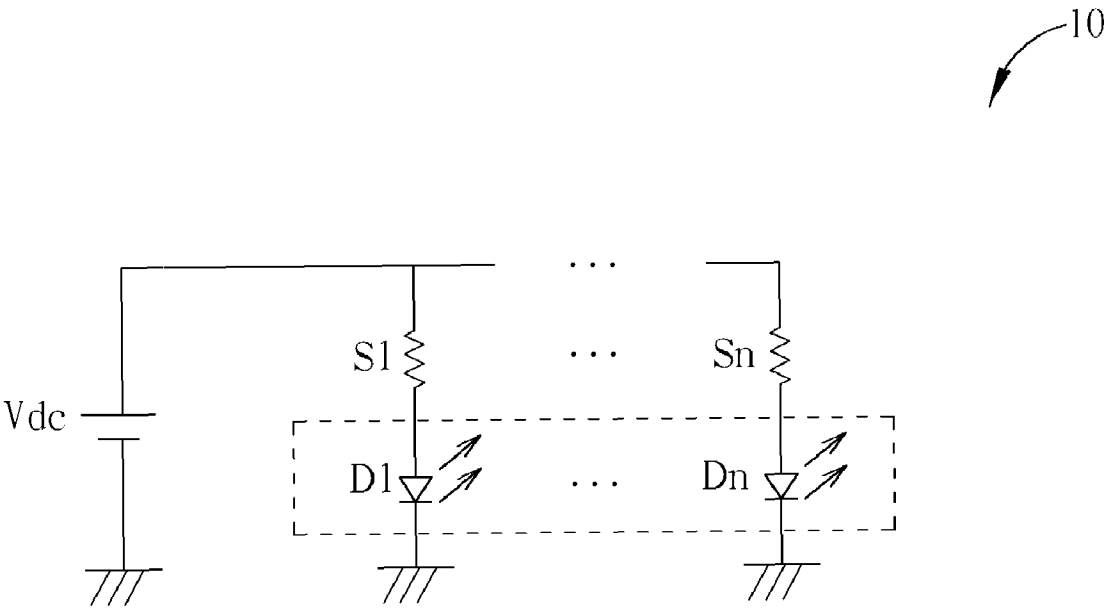
FIG. 1 is a schematic diagram of an LED backlight system driven by a voltage source.
Figure 2:
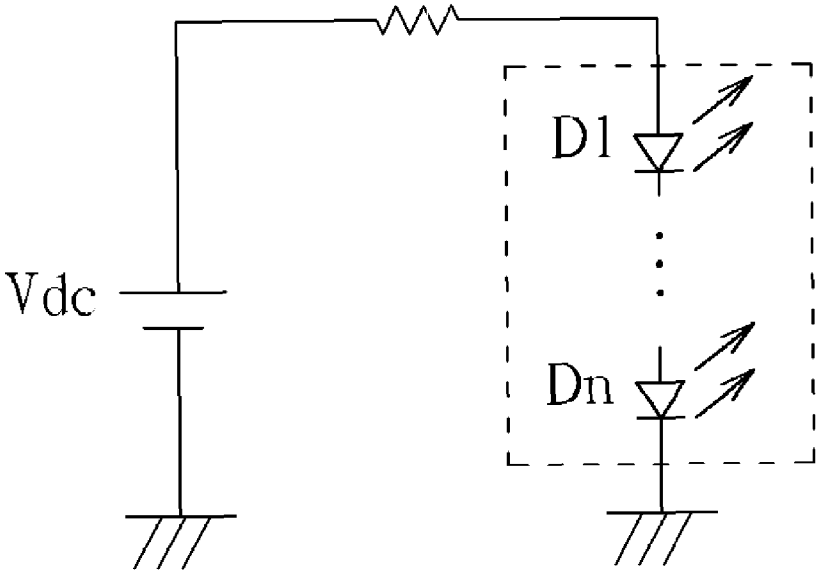
FIG. 2 is a schematic diagram of another LED backlight system driven by a voltage source.
Figure 3:
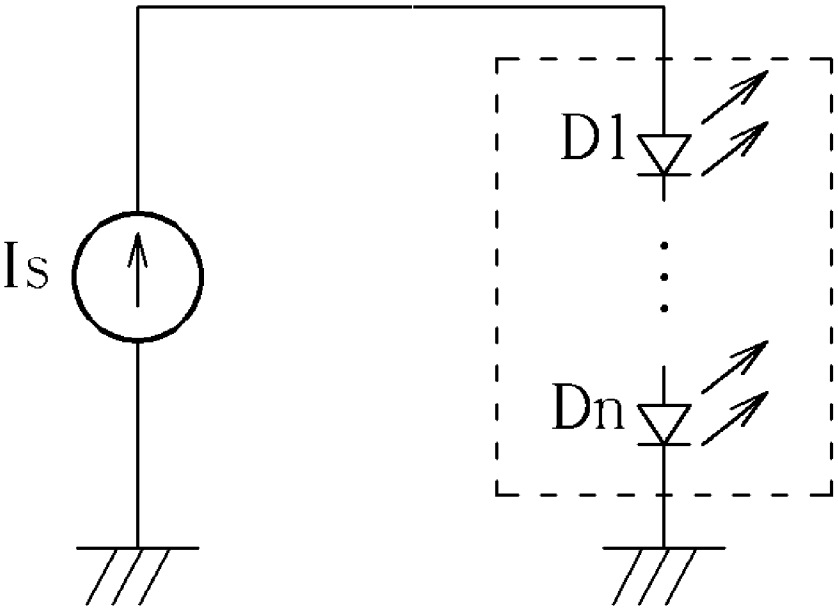
FIG. 3 is a schematic diagram of an LED backlight system driven by a current source.
Figure 4:
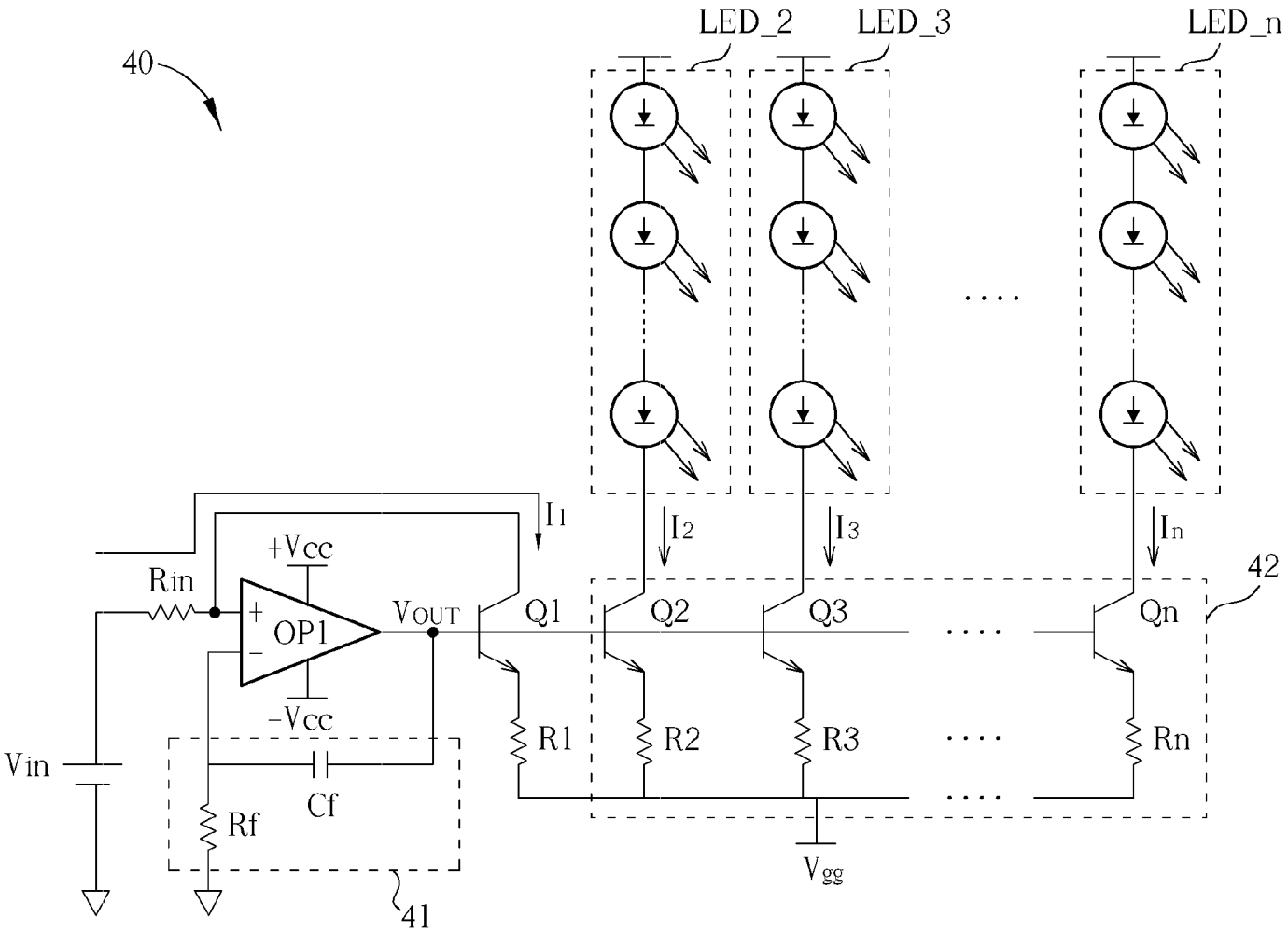
FIG. 4 is a schematic diagram of a driving circuit for an LED backlight system according to an embodiment of the present invention.

Please refer to FIG. 4, which is a schematic diagram of a driving circuit 40 for an LED backlight system according to an embodiment of the present invention. The driving circuit 40 includes an input voltage Vin, an input resistor Rin, an operational amplifier OP1, a first transistor Q1 and a current calculation unit 42. The positive input terminal of the operational amplifier OP1 is coupled to the input voltage Vin through the input resistor Rin. The output terminal of the operational amplifier OP1 is coupled to the negative input terminal through a feedback network 41. The first transistor Q1 is preferred to be a Bipolar Junction Transistor (BJT). The collector electrode of the first transistor Q1 is coupled to the positive input terminal of the operational amplifier OP1. The emitter electrode of the first transistor Q1 is coupled to a reference voltage Vgg through a reference resistor R1. The base electrode of the first transistor Q1 is coupled to the output terminal of the operational amplifier OP1, and used for draining a reference current I1 to control an output voltage Vout of the operational amplifier OP1 according to the input voltage Vin and the input resistor Rin. The current calculation unit 42 is coupled to the output terminal of the operational amplifier OP1 and the reference voltage Vgg, and used for generating working current I2~In proportional to the reference current I1 to drive LED strings LED_2~LED_n according to the output voltage Vout of the operational amplifier OP1.

Preferably, the feedback network 41 is composed of a feedback capacitor Cf and a feedback resistor Rf. The feedback capacitor Cf has one terminal coupled to the output terminal of the operational amplifier OP1 and an other terminal coupled to the negative input terminal of the operational amplifier OP1. The feedback resistor Rf has one terminal coupled to the negative input of the operational amplifier OP1 and an other terminal coupled to ground, as shown in FIG. 4. In addiction, the current calculation unit 42 further includes second transistors Q2~Qn. The second transistors Q2~Qn are all BJTs and have the same characteristics as the first transistor does. The collector electrodes of the second transistors Q2~Qn are individually coupled to the LED strings LED_2~LED_n. The emitter electrodes are individually coupled to the reference voltage Vgg through the current limiting resistors R2~Rn. The base electrodes are individually coupled to the output terminal of the operational amplifier OP1. The second transistors Q2~Qn are used for generating the working currents I2~In proportional to the reference current I1 according to the output voltage Vout of the operational amplifier OP1 and the resistances corresponding to the current limiting resistors. Regarding the detail descriptions, please continue to refer to the following statements.

Since the operational amplifier OP1 operates in the feedback mode, the positive input terminal and the negative input terminal of the operational amplifier OP1 have a virtual ground attribution. Such that the voltage level of the positive input terminal is equal to the voltage level of the negative terminal, which can be expressed by:

$$V_{(+)}=V_{(-)}=0 \tag{1}$$

In this situation, the current drained by the first transistor Q1 is given by:

$$I1=\frac{Vin}{Rin} \tag{2}$$

Since the current through the collector electrode of the first transistor Q1 is approximate to the current through the emitter electrode of the first transistor Q1, the output voltage Vout of the operational amplifier OP1 can be expressed by:

$$Vout=Vbe+I1\times R1+Vgg \tag{3}$$

Where, Vbe represents a voltage gap between the collector and the emitter. Besides, the second transistors Q2~Qn must satisfies Eq. (3) as well. As a result, when the current limiting resistors R2~Rn and the reference resistor R1 have an identical resistance, i.e. R1=R2= . . . =Rn, the working currents I2~In, generated by the second transistors Q2~Qn, are equal to the reference current I1, which can be expressed by:

$$I1=I2=\ldots=In=\frac{Vin}{Rin} \tag{4}$$

In other words, when the first transistor Q1 drains the reference current I1 through the input resistor Rin, the output voltage Vout of the operational amplifier OP1 is determined to control the second transistors Q2~Qn to generate the working currents I2~In identical to the reference current I1

Thus, the driving circuit 40 generates the constant working currents I2~In, irrelevant to the loads, to drive the LED strings LED_2~LED_n according to the input voltage Vin and the input resistor Rin. Consequently, the present invention not only reduces the current difference among each of the LED strings, but prevents the current from varying with temperature. Further, effectively controlling the brightness of the plurality of LED strings can be achieved.

Please note that the aforementioned embodiment is just one exemplary illustration of the present invention and thus can be modified by those skilled in the art based on practical requirements. For example, adjusting the resistances of the current limiting resistors R2~Rn to control the proportional relationship between the reference current I1 and the working currents I2~In generated by the second transistors Q2~Qn is also included in the scope of the present invention.

Figure 5:
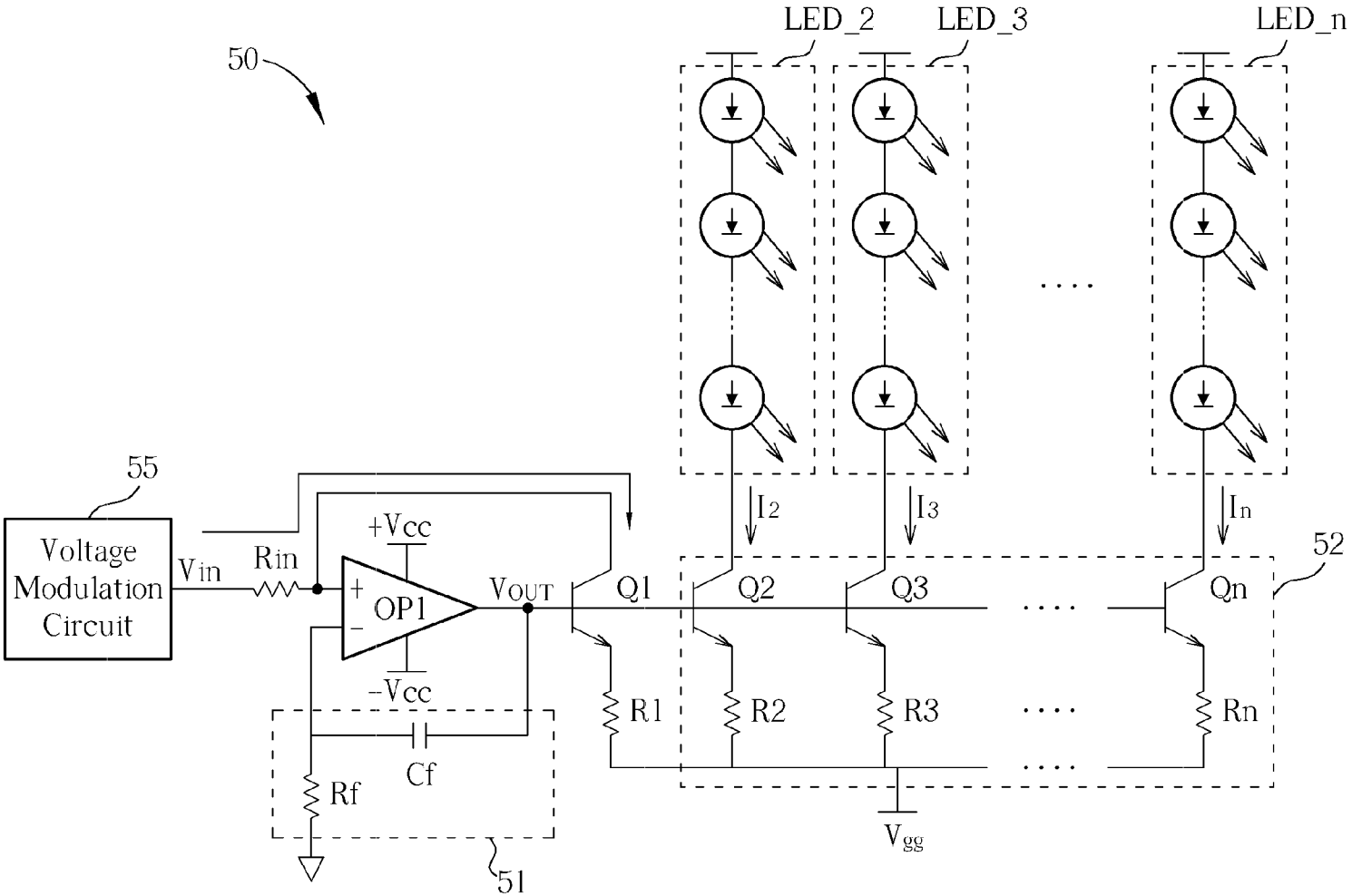
FIG. 5 is a schematic diagram of another driving circuit for an LED backlight system according to an embodiment of the present invention.

Apart from that, the driving circuit of the present invention can realize a backlight system with light dimming function for control of the brightness of the LEDs. For example, please refer to FIG. 5, which is a schematic diagram of a driving circuit 50 for an LED backlight system according to an embodiment of the present invention. The driving circuit 50 is similar to the driving circuit 40 shown in FIG. 4. The difference is that the driving circuit 50 includes a voltage regulation circuit 55, coupled to the input voltage Vin, for regulating levels of the input voltage Vin. Consequently, by regulating the input voltage Vin, the driving circuit 50 controls volume of the working currents to perform dimming on the LED strings LED_2~LED_n.

Figure 6:
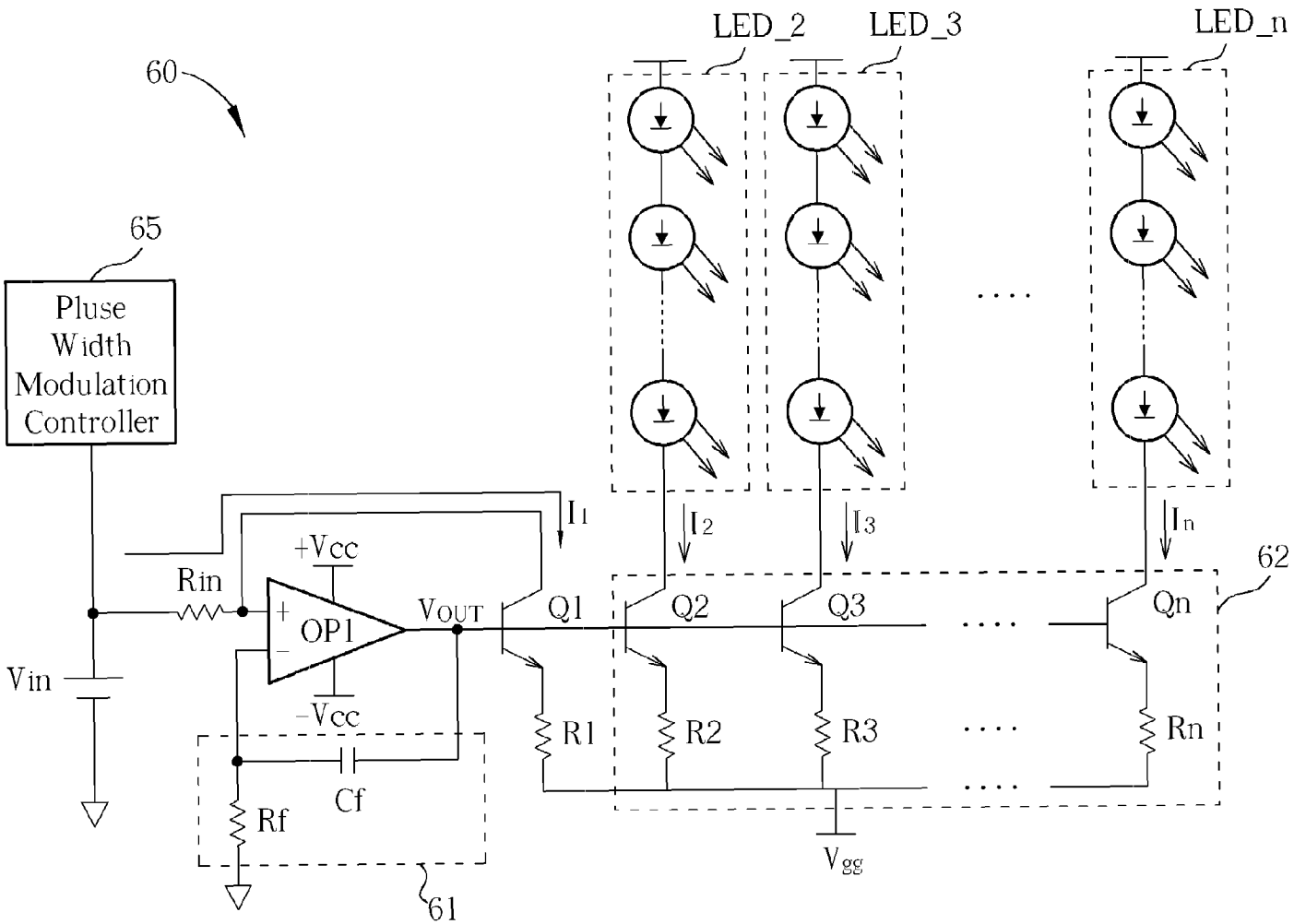
FIG. 6 is a schematic diagram of another driving circuit for an LED backlight system according to an embodiment of the present invention.
Figure 7:
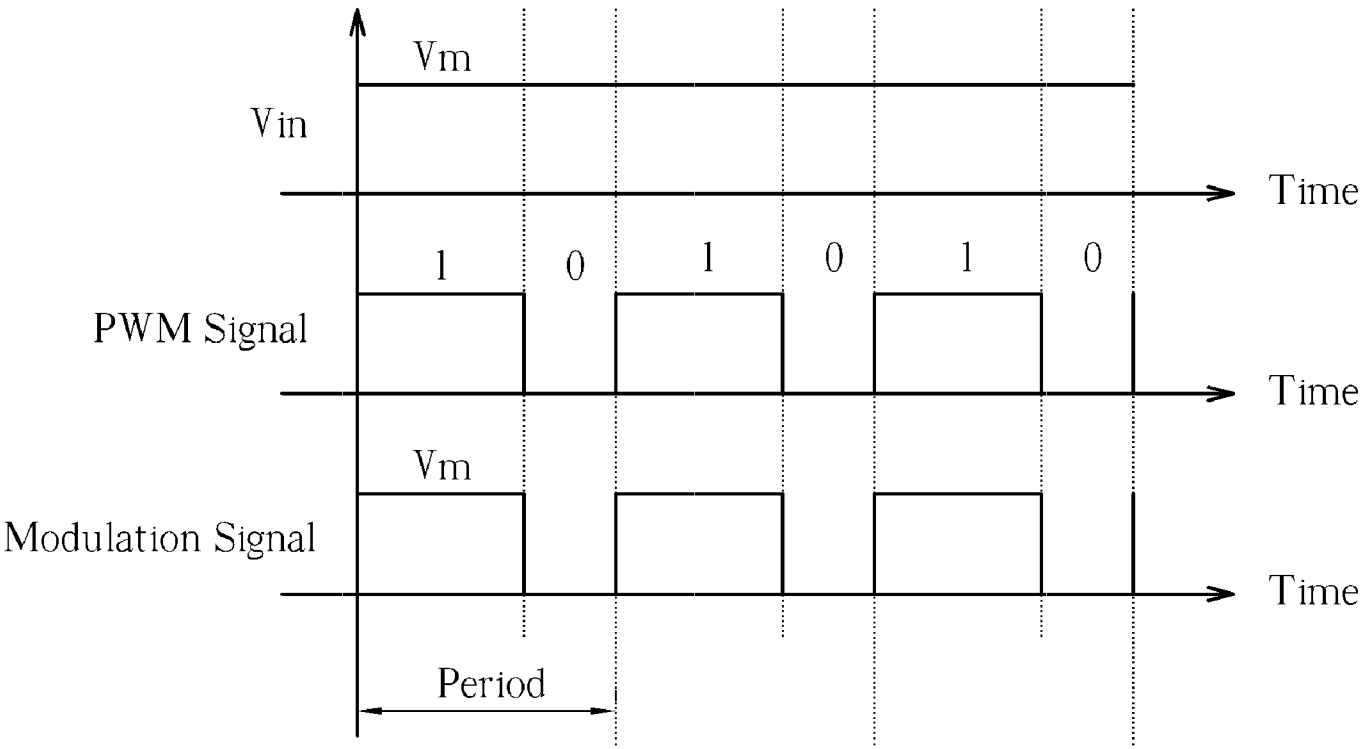
FIG. 7 is a waveform diagram corresponding to the driving circuit shown in FIG. 6.

On the other hand, please continue referring to FIG. 6, which is a schematic diagram of a driving circuit 60 for an LED backlight system according to an embodiment of the present invention. Compared with FIG. 5, the driving circuit 60 includes a pulse width modulation (PWM) controller 65, coupled to the input voltage Vin, for adjusting signal duration of the input voltage Vin to perform dimming on the LED strings LED_2~LED_n. The corresponding waveform diagram is shown in FIG. 7. Its operations is known to those skilled in the art, and thus omitted herein.

To sum up, the driving circuit of the present invention generates the constant working currents, irrelevant to the loads, to drive the LED strings according to the input voltage and the input resistor. Consequently, the present invention not only reduces the current difference among each of the LED strings, but prevents the current from varying with the temperature, such that effectively controlling the brightness of the LED strings can be achieved. In addiction, the present invention can utilize the simple circuit structure to realize the LED backlight system with the light dimming function for reducing cost and complexity.

Those skilled in the art will readily observe that numerous modifications and alterations of the device and method may be made while retaining the teachings of the invention.

What is claimed is:

1. A driving circuit for a light emitting diode (LED) backlight system, the driving circuit comprising:

an input voltage;

an input resistor;

an operational amplifier having a positive input terminal coupled to the input voltage through the input resistor, a negative input terminal, and an output terminal coupled to the negative input terminal through a feedback network;

a first transistor, having a first terminal coupled to the positive input terminal of the operational amplifier, a second terminal coupled to a reference voltage through a reference resistor, and a third terminal coupled to the output terminal of the operational amplifier, for draining a reference current to control an output voltage of the operational amplifier according to the input voltage and the input resistor; and a current calculation unit, coupled to the output terminal of the operational amplifier and the reference voltage, for generating a plurality of working currents proportional to the reference current to drive a plurality of LED strings according to the output voltage of the operational amplifier.

2. The driving circuit of claim 1, wherein the feedback network comprises:

a feedback capacitor having a first terminal coupled to the output terminal of the operational amplifier, and a second terminal coupled to the negative input terminal of the operational amplifier; and a feedback resistor having a first terminal coupled to the negative input terminal of the operational amplifier and the second terminal of the feedback capacitor, and a second terminal coupled to ground.

3. The driving circuit of claim 1, wherein the first transistor is a bipolar junction transistor (BJT), the first terminal of the first transistor is a collector electrode, the second terminal of the first transistor is an emitter electrode, and the third terminal of the first transistor is a base electrode.

4. The driving circuit of claim 1, wherein the current calculation unit comprises a plurality of second transistors, each of the plurality of second transistors, having a first terminal coupled to one of the plurality of LED strings, a second terminal coupled to the reference voltage through a current limiting resistor, and a third terminal coupled to the output terminal of the operational amplifier, for generating a working current of the plurality of working currents proportional to the reference voltage.

5. The driving circuit of claim 4, wherein each of the plurality of second transistors is a BJT transistor, the first terminal of each of the plurality of second transistors is a collector electrode, the second terminal of each of the plurality of second transistors is an emitter electrode, and the third terminal of each of plurality of second transistors is a base electrode.

6. The driving circuit of claim 4, wherein the working current generated by each of the plurality of second transistors is equal to the reference current when the current limiting resistor is equal to the reference resistor.

7. The driving circuit of claim 4, wherein electrical characteristics of the plurality of second transistors are identical to that of the first transistor.

8. The driving circuit of claim, 1 further comprising a voltage regulation circuit, coupled to the input voltage, for regulating levels of the input voltage to perform dimming on the plurality of LED strings.

9. The driving circuit of claim 1, further comprising a pulse width modulation (PWM) controller, coupled to the input voltage, for modulating the input voltage to perform dimming on the plurality of LED strings.

10. The driving circuit of claim 1, wherein the driving circuit is applied to a liquid crystal display (LCD).

* * * * *